US006637333B2

(12) United States Patent
Matich

(10) Patent No.: US 6,637,333 B2
(45) Date of Patent: Oct. 28, 2003

(54) APPARATUS TO AID IN FIXING DYE TO FABRIC

(76) Inventor: Lewis Matich, 7A-46 Mileham Street, Windsor, New South Wales 2756 (AU)

( * ) Notice: Subject to any disclaimer, the term of this patent is extended or adjusted under 35 U.S.C. 154(b) by 0 days.

(21) Appl. No.: 09/929,524

(22) Filed: Aug. 14, 2001

(65) Prior Publication Data

US 2003/0033950 A1 Feb. 20, 2003

(51) Int. Cl.[7] ..... B41F 23/04
(52) U.S. Cl. ..... 101/424.1; 101/417
(58) Field of Search ..... 101/424.1, 483, 101/417, 488, 487; 68/5 D, 5 R

(56) References Cited

U.S. PATENT DOCUMENTS

| | | | | | |
|---|---|---|---|---|---|
| 3,942,695 | A | * | 3/1976 | Fleissner | 226/1 |
| 3,967,473 | A | * | 7/1976 | Arioli et al. | 68/5 D |
| 4,052,796 | A | | 10/1977 | Arendt | 34/60 |
| 4,070,877 | A | * | 1/1978 | Fleissner | 68/5 D |
| 4,285,218 | A | * | 8/1981 | Lehmann | 68/5 D |
| 4,534,120 | A | | 8/1985 | Okazaki | 34/119 |
| 4,996,854 | A | | 3/1991 | Heidan et al. | 68/5 |
| 5,867,197 | A | | 2/1999 | Aoki | 347/106 |
| 5,966,145 | A | | 10/1999 | Miura et al. | 347/9 |
| 6,059,391 | A | | 5/2000 | Fulkerson et al. | 347/2 |

OTHER PUBLICATIONS

Sebek, G. Letter to (Australian) Commissioner of Patents dated Feb. 11, 2002 with attachments.

* cited by examiner

*Primary Examiner*—Andrew H. Hirshfeld
*Assistant Examiner*—Anthony H. Nguyen
(74) *Attorney, Agent, or Firm*—Ladas & Parry

(57) ABSTRACT

An apparatus (10) to aid in fixing dye to fabric having housing (15) having a portion (20) to receive and support a printer (25) to apply dye to the fabric (40) as it passes a predetermined location (50). A first set of rollers to provide for movement of the fabric (40) through the housing (15) so as to pass the location (50); a steamer (55) within the housing (15) and through which the fabric (40) passes after the location (50), the steamer (55) being adapted to aid in fixing the dye to the fabric (40); means (75) to deliver steam to the space; and wherein the apparatus (10) further includes: a second set of rollers to provide for the passage of the fabric (40) from the predetermined location (50) to the steamer (55).

7 Claims, 3 Drawing Sheets

APPARATUS TO AID IN FIXING DYE TO FABRIC

TECHNICAL FIELD

The present invention relates to printing machines and in particular to an apparatus having a fabric drive and continuous steaming unit to aid in fixing dye in a fabric.

BACKGROUND OF THE INVENTION

It is well known for printing establishments to have and operate ink jet machines that are capable of printing designs and/or patterns onto various compositions, such as, fabrics. In industrial applications these machines are required to print designs onto fabrics having a width from 200 millimetres to over 2 metres and therefore require large and sophisticated machinery.

When printing with such a technologically advanced machine problems arise in drying the dye too quickly, drying the fabric too slowly and/or fixing the dye to the fabric.

To this end, a fabric drive system and steaming unit has been built to control the fabric fed into the ink jet machine for printing then control the fixation of said print to the fabric.

Accordingly, there is a need for a fabric drive and steaming unit for cooperation with a printing machine which fixes the dye to the fabric continuously and consistently to allow for a reliable fixation.

OBJECT OF THE INVENTION

It is an object of the present invention to overcome or ameliorate some of the disadvantages of the prior art, or at least to provide a useful alternative.

SUMMARY OF THE INVENTION

There is firstly disclosed an apparatus to aid in fixing dye to fabric, said apparatus including:

a housing having a portion to receive and support an inkjet printer to apply dye to the fabric as the fabric passes a predetermined locations;

a housing;

a first set of rollers to provide for movement of the fabric through said housing so as to pass a predetermined location at which a dye is applied to said fabric;

a steamer within said housing and through which the fabric passes after said location, and including an enclosure member providing a space to receive steam and through which the fabric passes so that the steam aids in fixing the dye to the fabric;

a steam generator to deliver steam to said space;

a water removal device to remove condensation from said space, said enclosure member shaped to drain condensation collected on said member to said water removal device; and wherein said apparatus further includes:

a second set of rollers to provide for the passage of the fabric from said predetermined location to said steamer.

Preferably, said first and second set of rollers define a fabric run within said housing.

Preferably, said first set of rollers includes locating means for presenting said fabric in a predetermined orientation at said predetermined location.

Preferably, said enclosure member is bell shaped but not limited to this shape.

Preferably said water removal device includes water traps for receipt of said condensation.

Preferable, upon operation of said generator the temperature within said steamer increases, the moisture content of said fabric increases and any excess condensed water is retained by said water traps to be reused in conversion back into steam.

There is further disclosed herein a steamer to aid in fixing dye to fabric said steamer including:

an enclosure member providing a space through which the fabric passes;

means to deliver steam to said space;

water removal means to remove condensation from said space; and wherein said member is shaped to drain condensation collected on said member to said water removal means.

There is further disclosed herein a method of fixing dye to fabric, said method including:

(1) attaching a printer to an apparatus for fixing dye to fabric;

(2) connecting said apparatus and printer between a dispensing spool and a return spool;

(3) connecting a roll of fabric between said dispensing and return spool and a plurality of guide rollers defining a fabric run therebetween;

(4) placing said fabric under tension by running said fabric through a predetermined location within said printer;

(5) disposing a layer of dye on said fabric in a preselected design or pattern at said predetermined location, (6) air drying said layer of dye and fabric for a predetermined length of time;

(7) passing said layer of dye and fabric through a steamer unit;

(8) steaming said layer of dye and fabric whilst passing through said steamer unit to fix said dye to said fabric; and (9) retrieving said fixed layer of dye and fabric in a roll located at said return spool.

Preferably, the present invention allows fixation and printing of digital printed fabrics in one continuous operation.

BRIEF DESCRIPTION OF THE DRAWINGS

A preferred form of the present invention will now be described, by way of example only, with reference to the accompanying drawings wherein.

DETAILED DESCRIPTION OF THE PREFERRED EMBODIMENTS

Figure 1:
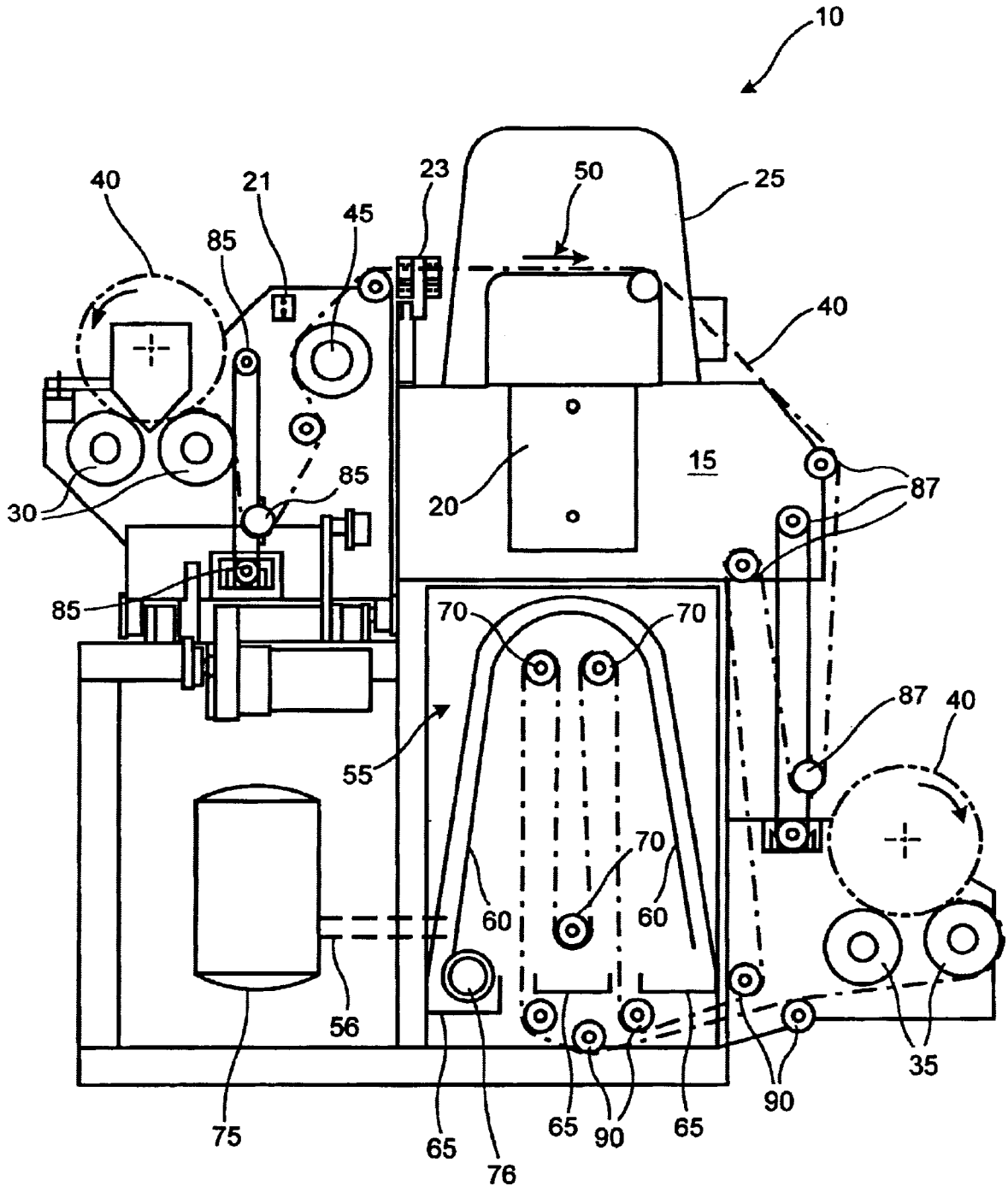
FIG. 1 is a schematic partial sectional view of an apparatus to aid in fixing dye to fabric according to an embodiment of the present invention.
Figure 2:
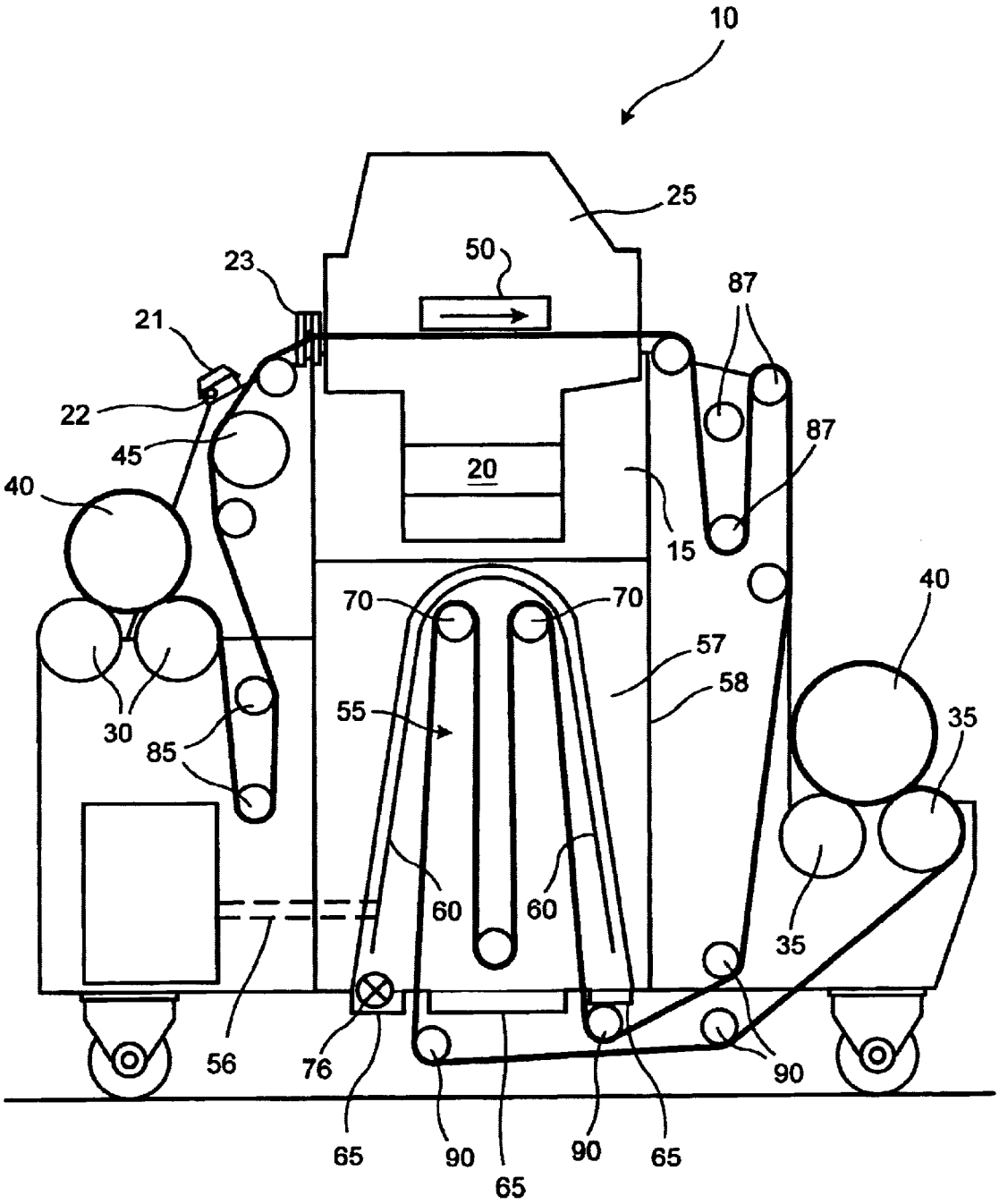
FIG. 2 is a schematic partial sectional view of an apparatus to aid in fixing dye to fabric according to an embodiment of the present invention.
Figure 3:
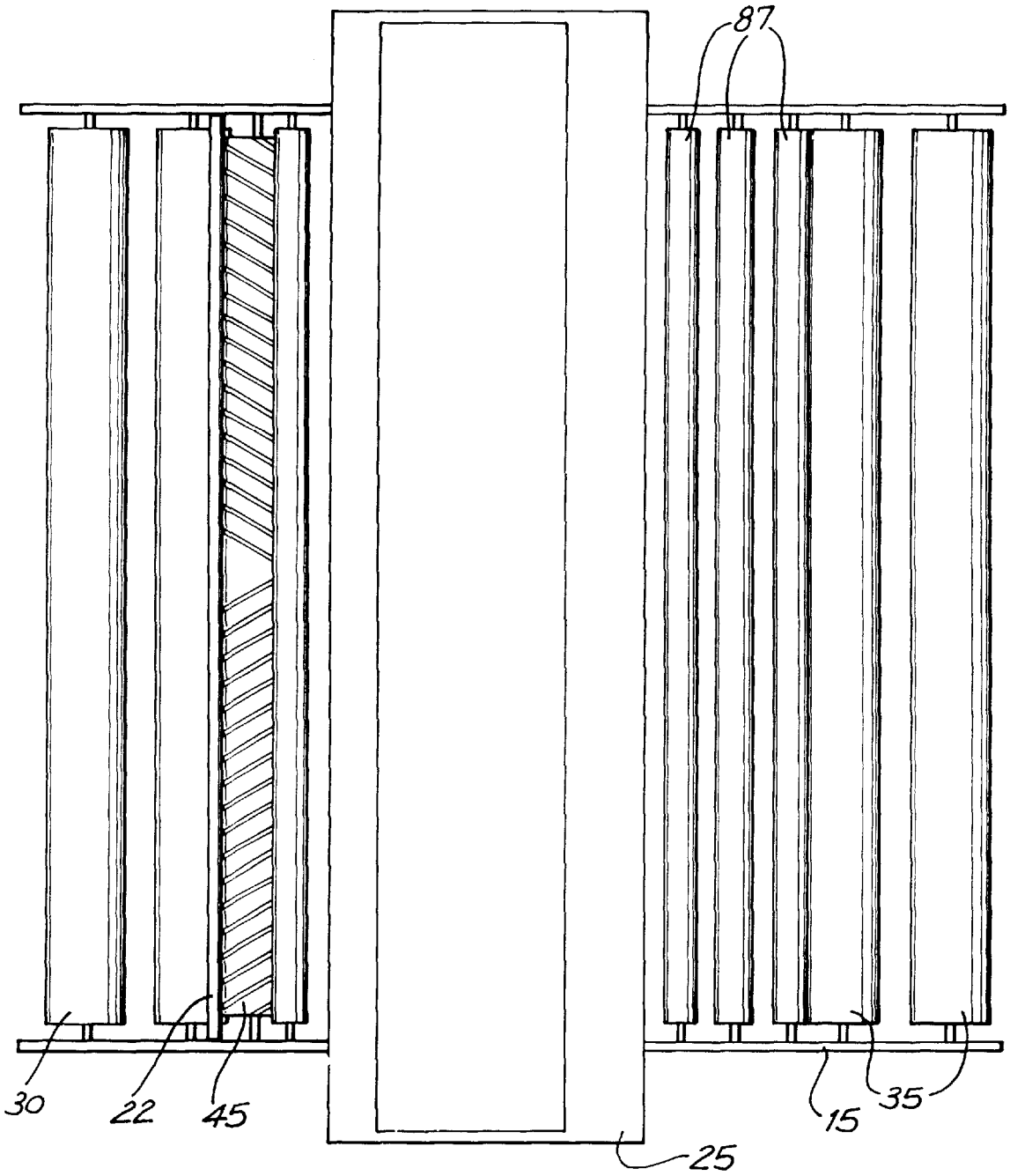
FIG. 3 is a plan view of the apparatus as shown in FIG. 2.

In FIGS. 1 to 3 of the accompanying drawings, there is schematically depicted an apparatus 10 to aid in fixing dye to fabric. The apparatus 10 includes a housing 15 having a portion 20 to receive and support an ink jet printer 25. The apparatus 10 further includes a dispensing assembly 30 and assembly spool 35 for receipt of a roll of fabric 40. The apparatus 10 may also include a joining mechanism 21 to allow two rolls of fabric to be easily joined. The joining mechanism 21 includes a pin rail 22 which allows two lengths of fabric to be easily held together straight and tight for joining.

The housing 15 includes scroll roll 45 located on the in feed side of the printer 25 and adapted to provide a spreading of the fabric 40 feeding into the printer 25 so that the fabric 40 is flat with no buckles or folds.

The ink jet printer 25 applies ink, dye or other printing mediums to the fabric 40 in a preselected design or pattern by digital means. It will be appreciated by those skilled in the art that a variety of printers may be used for this application.

The housing 15 further includes a steamer 55 in the form of a bell shaped enclosure 55 located within the housing 15 and through which the fabric 40 passes. The bell shaped enclosure 55 is shaped such that condensation may drain down its internal surfaces 60 into one or more water removal devices or traps 65 located at a predetermined position such as the base of the enclosure 55. These water traps 65 can be removable so as to empty water build up. It will be appreciated, however, that they may also be integrally formed with the enclosure 55, including drainage ports or any other means to collect and then remove or recycle water build-up. Inside the enclosure 55 is a plurality of rollers 70 around which the fabric 40 passes. A steam generator 75 is located in close proximity to the enclosure 55 and supplies steam into the enclosure 55 as shown diagrammatically at reference numeral 56 thereby increasing the moisture content of the fabric 40, additional super heated steam may be utilized for fixation of synthetic fibres. A steam reheater 76 may also be provided. The steam condenses on the internal surfaces 60 of the enclosure 55 and flows towards water traps 65 thereby eliminating condensation drops on the fabric 40. The unique design of the steamer utilizes a suspended inner skin within a second skin, the second skin may be insulated 57 before being encased in a third outer skin 58. The innermost skin has minimal contact with the second skin allowing the inner skin to rapidly achieve and maintain an equal temperature with the steam, thus eliminating condensate formation. The design of the inner suspended skin combined with the second skin is such that excess steam is directed up in between the two skins for recycling thus preventing the steam escaping from the chamber during fixation. The enclosure 55 can include suitable insulating material to retain heat within the enclosure 55 whilst not affecting other componentry of the apparatus 10. This steaming of the fabric 40 aids in fixing the dye to the fabric 40.

The dispensing assembly 30 includes two elongate rollers located parallel and slightly apart to allow a roll of fabric 40 to be positioned therebetween. Upon rotation of the rollers about their longitudinal axis the fabric roll 40 dispenses a length of fabric 40 away from the dispensing assembly 30. The dispensing assembly 30 is of such size that the easy loading and unloading of any size roll of fabric 40 is provided for. The end of the assembly 30 can include a set of electronic senses 23 that determine the location of the edge of the roll of fabric 40 and adjust the feed rollers 30 side to side so as to maintain the edge of the fabric 40 consistently in the same position irrespective of the way the fabric 40 has been placed or rolled.

The dispensing assembly 30 in a further embodiment may be integrally formed with the housing 15. The length of fabric departing the dispensing assembly 30 is in communication with a plurality of rollers 8 which apply a precise tension to the fabric 40 entering the printer 25. Likewise a similar set of rollers 87 exists on the exit side of the printer 25 applying a precise tension to the fabric 40 as it leaves the printer 25 irrespective of the weight of the fabric 40 and irrespective of the size of the roll.

As described, the apparatus 10 is attached to a printer 25 and connected between the dispensing assembly 30 and return spool 35 connecting a roll of fabric 40 between the assembly/spool 30, 35 over a plurality of guide rollers 70, 85, 87, 90 defining a fabric run therebetween. The dispensing assembly 30 and return spool 35 are then rotated about their longitudinal axis by motor means (not shown). It will be appreciated by those skilled in the art that the motor means may be in any form. The fabric 40 is then run through the scroll roller 45 to ensure the fabric is presented to the printer 25 spread out perfectly flat, thereby preventing ripples forming in the fabric 40 under the printer head (not shown). Once inside the printer 25 the fabric 40 is run passed the predetermined location 50 of the printer 25 such that a layer of dye is deposited on at least one surface of the fabric 40 in a preselected design or pattern. On exiting the printer 25 the fabric 40 is guided along the series of rollers 87 and 90 thereby tensioning as well as airing the fabric 40 so as to partially dry the dye in the fabric 40. The distance from the printer 25 to steamer 55 is such that the dyes dry on the surface of the fabric 40 but retains the water from the dye absorbed by the fabric 40. This allows the fabric 40 to enter the steamer 55 with a higher moisture content than fully dried fabric which accelerates the fixation of the dyes. The fabric 40 is then passed through the steamer 55 by running the fabric 40 along the plurality of rollers 70, 90 within the steaming enclosure 55. The fabric 40 has a dwell time within the steamer 55 of 20 to 40 minutes. This ensures fixation of the dye into the fabric 40, which is achieved by raising the temperature of the fabric 40 in a very humid environment. The resultant temperature results in the fabric 40 drying very quickly upon exiting the steamer 55 thereby allowing the fabric 40 to be re-rolled dry on the return spool 35.

Although the invention has been described with references to specific examples, it would be appreciated by those skilled in the art that the invention may be embodied in many other forms.

What is claimed is:

1. An apparatus to aid in fixing dye to fabric, said apparatus including:

a housing;

a first set of rollers to provide for movement of the fabric through said housing so as to pass a predetermined location at which a dye is applied to said fabric;

a steamer within said housing and through which the fabric passes after said location, and including an enclosure member providing a space to receive steam and through which the fabric passes so that the steam aids in fixing the dye to the fabric, said enclosure member being shaped to drain condensation collected on an internal surface of said member to a predetermined position;

a steam generator to deliver steam to said space;

a water removal device to receive and remove said condensation from said predetermined position; and wherein said apparatus further includes:

a second set of rollers to provide for the passage of the fabric from said predetermined location to said steamer.

2. The apparatus according to claim 1, wherein said apparatus further includes a third set of rollers to provide for the passage of the fabric from said steamer.

3. The apparatus according to claim 1, wherein said first and second set of rollers define a fabric run within said housing.

4. The apparatus according to claim 1, wherein said first set of rollers includes locating means for presenting said fabric in a predetermined orientation at said predetermined location.

5. The apparatus according to claim 1, wherein said enclosure member is bell shaped.

6. The apparatus according to claim 1, wherein said water removal device includes water traps for receipt of said condensation.

7. The apparatus according to claim 1, wherein said enclosure member includes an arcuate central portion and diverging side portions.

* * * * *